US006942505B2

(12) United States Patent
Yagi et al.

(10) Patent No.: US 6,942,505 B2
(45) Date of Patent: Sep. 13, 2005

(54) CARD CONNECTOR

(75) Inventors: Masanori Yagi, Ebina (JP); Yoshikazu Ito, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/482,020

(22) PCT Filed: Jun. 14, 2002

(86) PCT No.: PCT/US02/19031

§ 371 (c)(1),
(2), (4) Date: Jul. 6, 2004

(87) PCT Pub. No.: WO03/003526

PCT Pub. Date: Jan. 9, 2003

(65) Prior Publication Data

US 2004/0248469 A1 Dec. 9, 2004

(30) Foreign Application Priority Data

Jun. 26, 2001 (JP) ..... 2001/193229

(51) Int. Cl.[7] ..... H01R 13/62
(52) U.S. Cl. ..... 439/159
(58) Field of Search ..... 439/159, 160, 439/152, 155, 157, 374, 372, 377, 70; 361/684, 685, 754, 756

(56) References Cited

U.S. PATENT DOCUMENTS

| | | | | | |
|---|---|---|---|---|---|
| 6,030,238 | A | * | 2/2000 | Dong | 439/159 |
| 6,200,153 | B1 | * | 3/2001 | Pei | 439/342 |
| 6,520,784 | B2 | * | 2/2003 | Ito et al. | 439/159 |
| 6,609,918 | B2 | * | 8/2003 | Uchikawa | 439/159 |
| 6,619,971 | B1 | * | 9/2003 | Chen | 439/159 |
| 6,695,637 | B1 | * | 2/2004 | Liu | 439/377 |
| 6,747,868 | B2 | * | 6/2004 | Shin | 361/684 |

* cited by examiner

*Primary Examiner*—Alexander Gilman
(74) *Attorney, Agent, or Firm*—Charles S. Cohen

(57) ABSTRACT

A memory card connector includes a main body and mounted on the body for receiving a memory card therebetween. The card is insertable to a fully mated position, and the cover is mounted for movement on the body from an inoperative position to an eject position. An eject device includes a single spring mounted on the body and having a first portion. Operatively associated with the cover to bias the cover toward its inoperative position. A second portion of the single spring is operatively associated with the memory card for biasing the card in an eject direction away from its mated position.

19 Claims, 9 Drawing Sheets

CARD CONNECTOR

FIELD OF THE INVENTION

This invention generally relates to the art of memory card connectors and, particularly, to an improved eject device for such connectors.

BACKGROUND OF THE INVENTION

FIG. 9 shows a memory card connector, generally designated 10, according to the prior art. The connector includes a main body 12 and a cover 14. The cover is slidably mounted on the body between an inoperative position P1 and an eject position P2. An eject device, generally designated 16, is provided for ejecting a memory card inserted into the connector between body 12 and cover 14.

Eject device 16 includes a rotary member 18 mounted on body 12, along with a torsion coil spring 20. The torsion coil spring is located such that one end thereof abuts against an inner wall of the body and an opposite end thereof is fixed to rotary member 18 to urge the rotary member in a clockwise direction by the coil spring.

When cover 14 is slidably moved from its inoperative position P1 to its eject position P2, a leading edge 18A of rotary member 18 is engaged with a protruding portion 14*a* projecting from the upper surface of cover 14, to thereby inhibit rotation of rotary member 18.

When cover 14 reaches its eject position P2, leading edge 18A of the rotary member disengages from protruding portion 14*a* of the cover, so that stored energy in coil spring 20 rotates the rotary member in the clockwise direction. The rotary member is provided with a card push-out portion 18*b*, so that when a memory card is inserted between the body and the cover, it is ejected by the card push-out portion in a direction indicated by arrow "A".

After the memory card is ejected, cover 14 is slidably moved back to its inoperative position P1 by the action of a separate, second spring 22 interconnected between the body and the cover. In conjunction therewith, rotary member 18 is rotated counterclockwise by the action of protruding portion 14*a* on the cover engaging the rotary member.

A problem with the eject system of prior art connector 10 is that it requires one torsion coil spring 20 for effecting ejection of the memory card, and a second spring 22 for slidably moving cover 14. These multiple spring components unduly increase the number of components of the overall connector, which correspondingly increases assembly time, lowers productivity of the connector and increases the cost of the connector. The multiple springs also detract from providing as simple and compact a connector as possible. The present invention is directed to solving these problems by providing an eject device which has a single spring with multiple portions for performing multiple functions of ejecting the memory card as well as moving the cover.

SUMMARY OF THE INVENTION

An object, therefore, of the invention is to provide a new and improved memory card connector with an improved eject device.

In the exemplary embodiment of the invention, the connector includes a main body and a cover mounted on the body for receiving a memory card therebetween. The card is insertable to a full mated position. The cover is mounted for movement on the body from an inoperative position to an eject position. An eject device includes a single spring mounted on the body. The spring has a first portion operatively associated with the cover to bias the cover toward its inoperative position, and a second portion operatively associated with the memory card for biasing the card in an eject direction away from its mated position. Inhibiting means are operatively associated between the cover and the second portion of the single spring to prevent the second portion from ejecting the card until the cover substantially reaches its eject position.

As disclosed herein, the single spring comprises a torsion coil spring having one end thereof engageable with the cover and an opposite end thereof operatively associated with the card. Specifically, the opposite end of the torsion coil spring is attached to a rotary member of the eject device. The rotary member is mounted for rotation about an axis coincident with an axis of the torsion coil spring.

The inhibiting means is operatively associated between the cover and the rotary member and includes a latch arm on the cover engageable with a latch surface on the rotary member. The latch arm is positioned for moving off the latch surface when the cover substantially reaches its eject position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
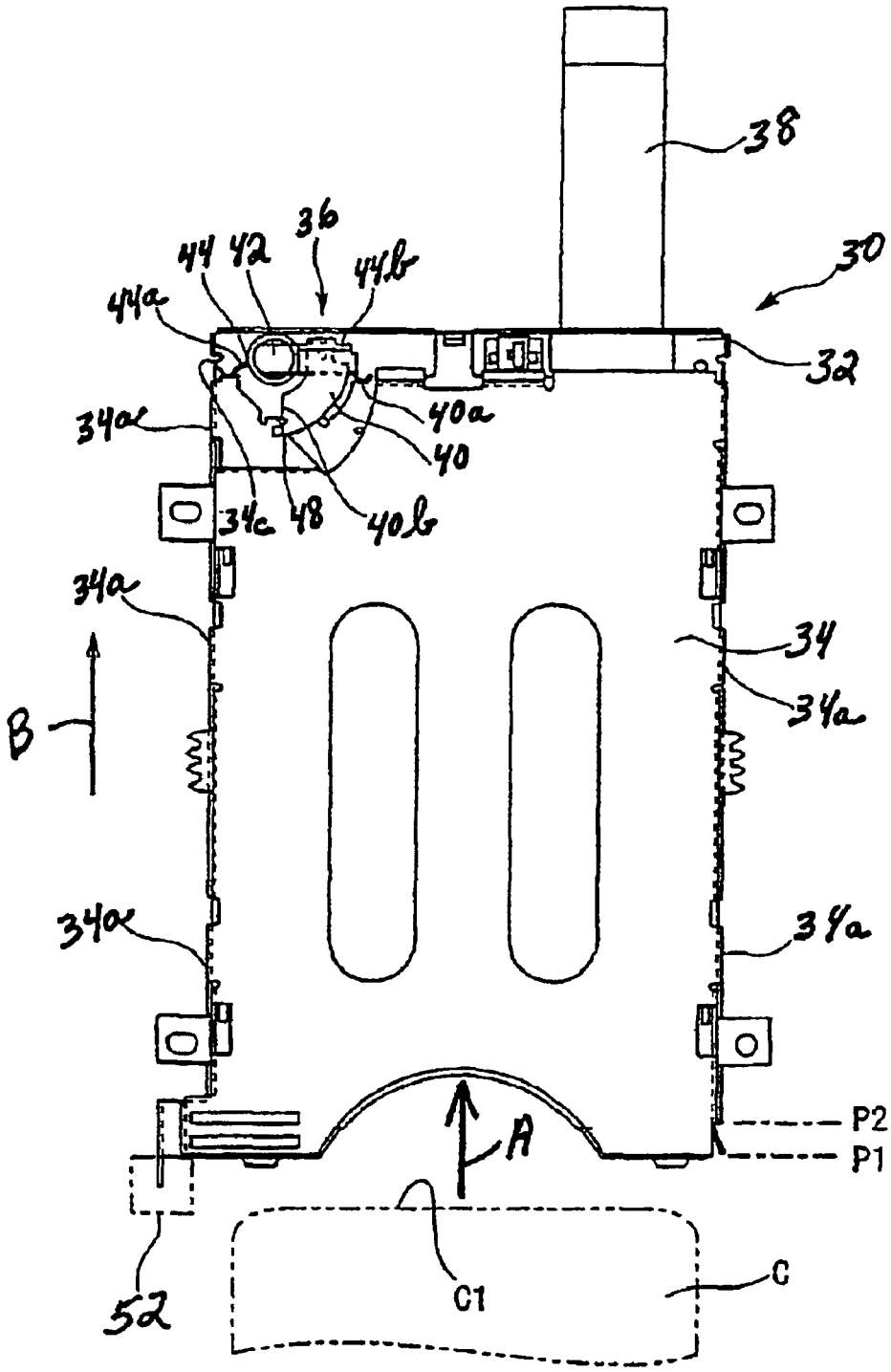
FIG. 1 is a plan view of a memory card connector according to the invention.
Figure 2:
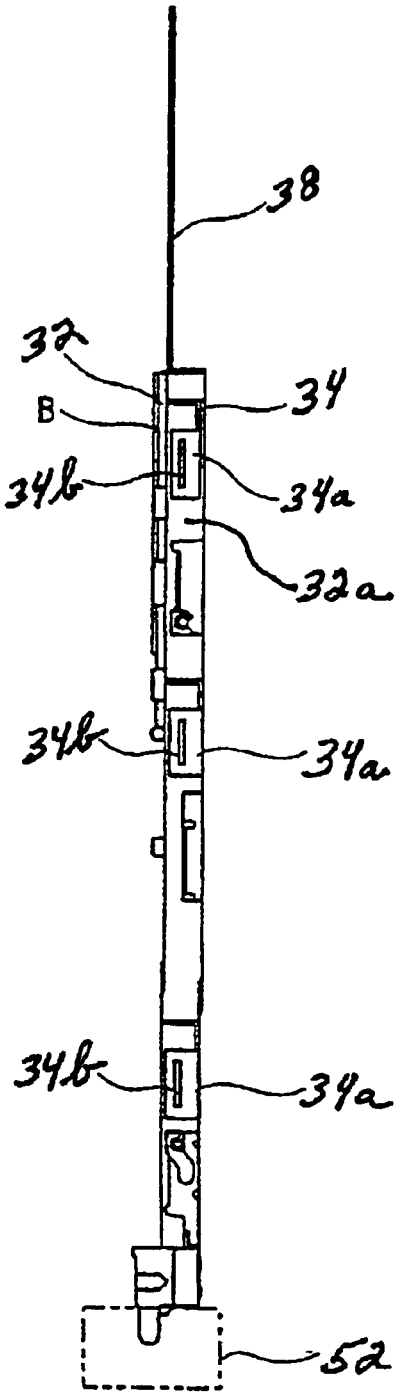
FIG. 2 is a side elevational view of the card, looking at the left-hand side of FIG. 1.

Referring to the drawings in greater detail, and first to FIGS. 1 and 2, the invention is embodied in a memory card connector, generally designated 30, which has a thin box-like shape substantially rectangular in a plan view and includes a main body 32 and a cover 34. The cover is superimposed and mounted on the body for sliding movement relative thereto between an inoperative position P1 and an eject position P2. An eject device, generally designated 36, is provided for ejecting a memory card C which is inserted between body 32 and cover 34 in the direction of arrow "A" (FIG. 1), to a fully inserted or mated position, described hereinafter.

Main body 32 has upwardly extending side walls 32 (FIG. 2). Both side edges of cover 34 have downwardly bent tabs 34*a* which are provided with slits 34*b* which received convex portions on side walls 32*a* of body 32. The convex portions which are disposed in slits 34*b* not only attach the cover to the body but cooperatively guide sliding movement of the cover relative to the body.

As seen in FIG. 2, a thin board B is mounted to aback or underside of body 32. The board is a circuit board with wiring patterns and terminals that are connected to the wiring patterns, although the wiring patterns and terminals are not visible in the drawings. The terminals are engageable with contacts (not shown) on the underside of memory card C when it is inserted into its fully mated position within the connector. An electrical cable 38 is connected to the wiring patterns on circuit board B. Although not visible in the drawings, the terminals on the circuit board extend through holes formed in body 32 and into the card-receiving space between the body and cover 34, so that the terminals contact the contacts on the underside of the memory card when in its fully mated position.

Figure 3:
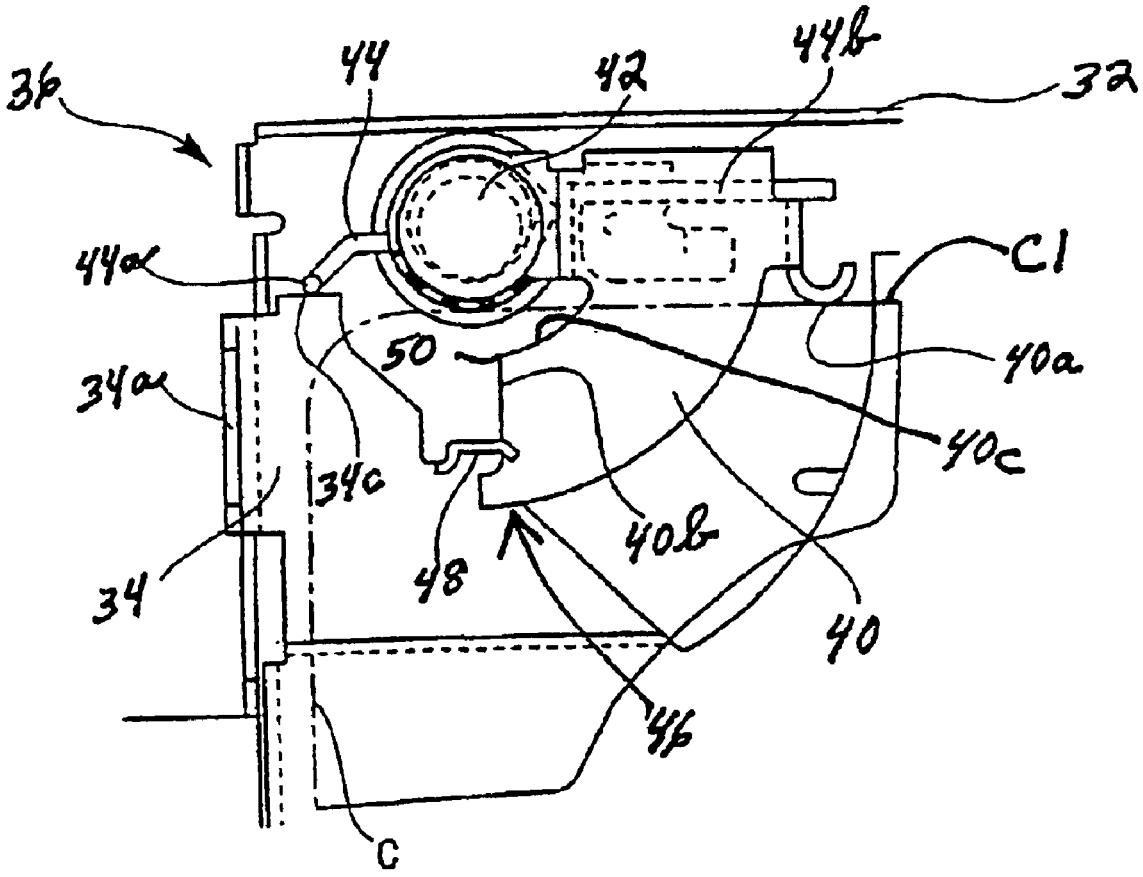
FIGS. 3–8 are enlarged-scale plan views of the corner of the connector where the eject device is located and showing sequential views of the operation thereof.

Referring to FIG. 3 in conjunction with FIG. 1, eject device 13 includes a rotary member 40 rotatably mounted on a rotational shaft 42 which is integral with or mounted to body 32. A single torsion coil spring 44 embraces the rotational shaft, whereby the axis of the torsion coil spring is coincident with the axis of rotation of rotary member 40. Generally, the single coil spring has a first portion or end 44*a* operatively associated with cover 34 to bias the cover toward its inoperative position P1. The torsion coil spring 15 has a second portion or opposite end 44*b* operatively associated with memory card C for biasing the card in an eject direction opposite the insertion direction of arrow "A" (FIG. 1).

More particularly, first portion or end 44*a* of torsion coil spring 44 engages a leading end 34*c* of cover 34. The second portion or opposite end 44*b* of the torsion coil spring is secured to rotary member 40 which has a card push-out portion 40*a* which engages a front or lead edge C1 of memory card C.

Generally, an inhibiting means, generally designated 46 (FIG. 3), is operatively associated between cover 34 and second portion 44*b* of torsion coil spring 44, to prevent the second portion of the coil spring from ejecting the memory card until the cover substantially reaches its eject position P2. In particular, a latch arm 48 is provided on the cover and is engageable with a latch sure 40*b* on rotary member 40. The latch arm is slidably movable along the latch surface until the latch arm reaches an end-point 50 of the latch surface, whereat the latch arm disengages from the latch surface and moves onto an inner circumferential surface 40*c*, for purposes described hereinafter.

Figure 4:
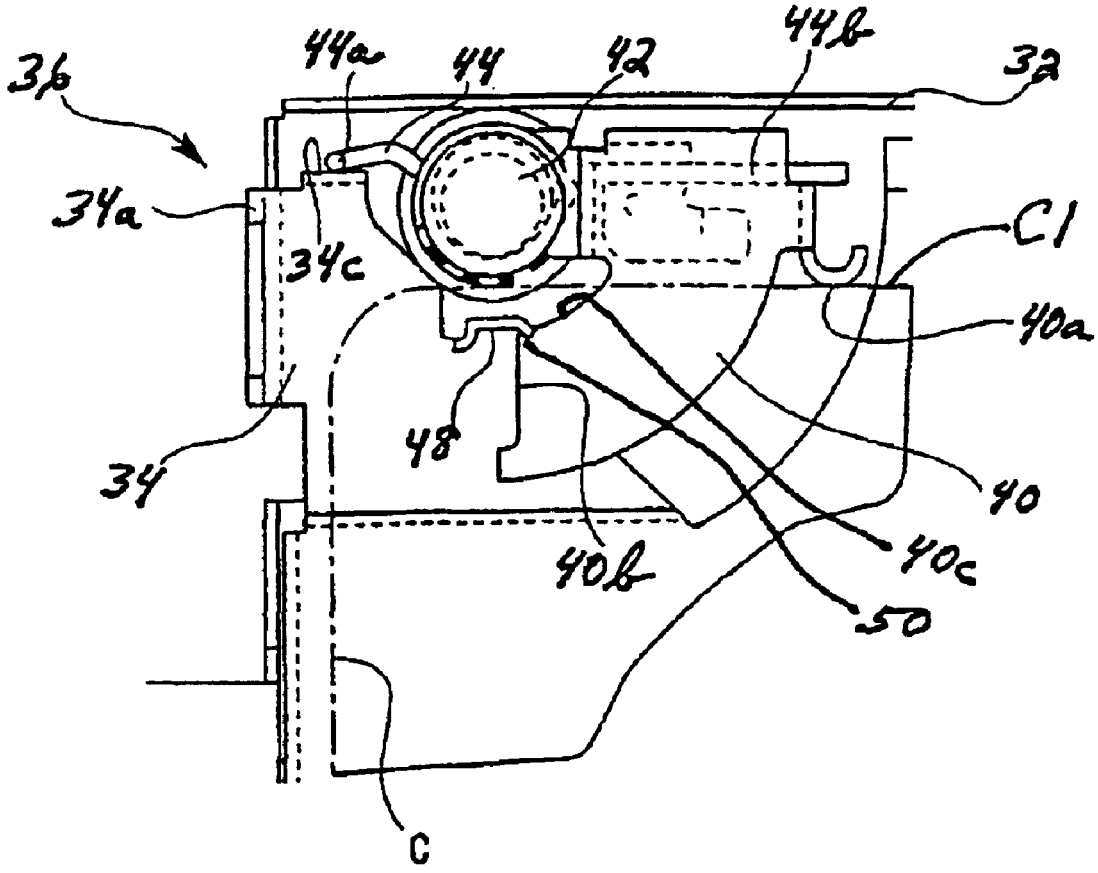

The operation of eject device 36 now will be described. For ejection purposes, an eject button 52 (FIGS. 1 and 2) may be attached to cover 34. An operator pushes in on the eject button to cause cover 34 to sidably move on body 32 in the direction of arrow "B" (FIG. 1). The cover is moved from its inoperative position P1 to its eject position P2. During the course of this sliding movement, leading end 34*c* of the cover is in engagement with the first portion or end 44*a* of torsion coil spring 44. FIG. 3 shows the position of the cover and first end 44*a* of the spring when tile cover is in its inoperative position. FIG. 4 shows the cover having been pushed toward its eject position, and it can be seen that first end 44*a* of the torsion coil spring has moved with the cover to store further energy in the first end of the spring. However, it should be noted in FIG. 4 that, while latch arm 48 on the cover has moved along latch surface 40*b* of rotary member 40, the rotary member still is inhibited from rotating clockwise because latch arm 50 has not reached end-point 40 of the latch surface.

Figure 5:
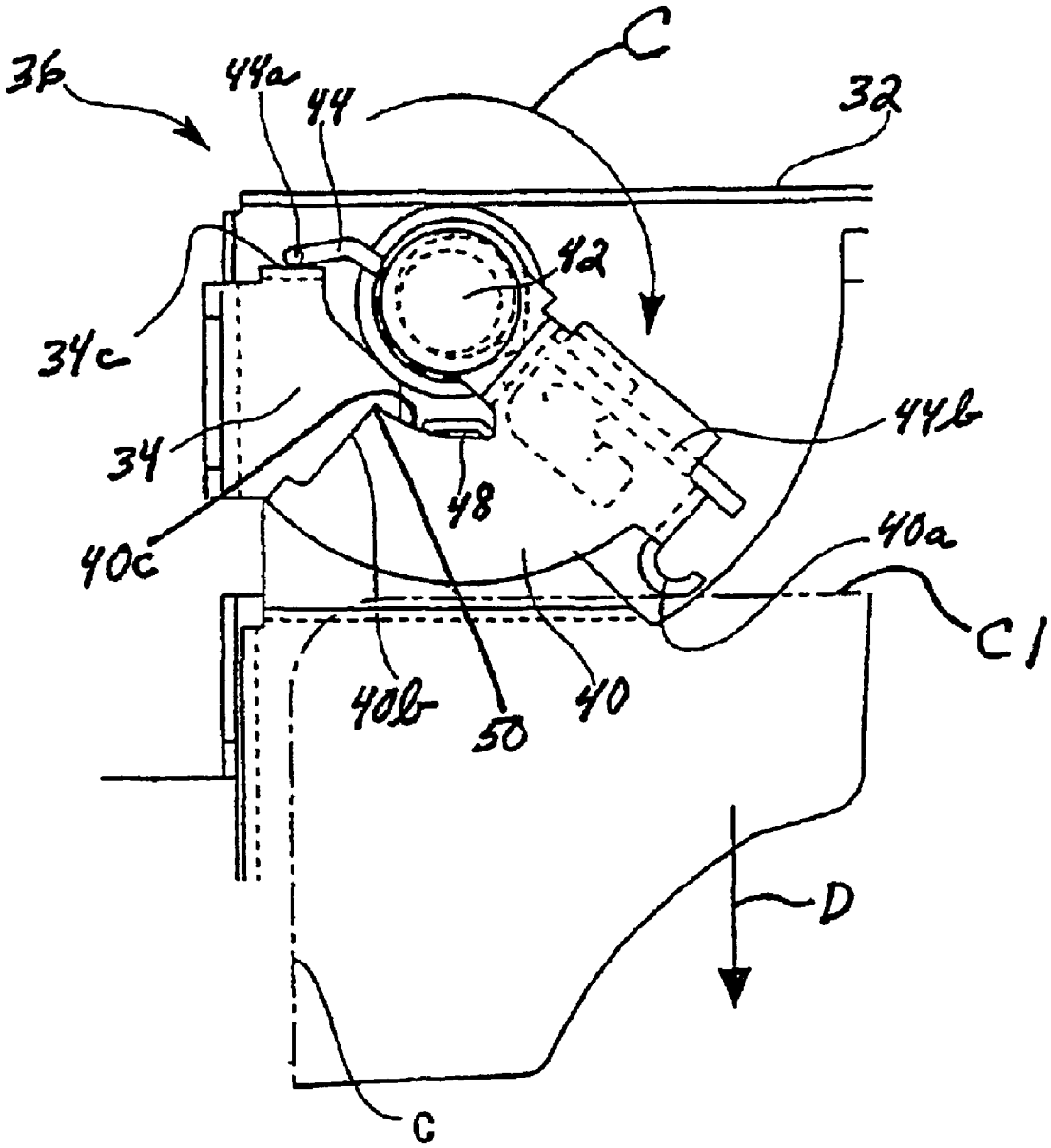

FIG. 5 shows cover 34 having been moved completely to its eject position P2. It can be seen that latch arm 48 has moved off of end-point 50 of latch surface 40*b* and onto inner circumferential surface 40*c*, whereupon rotary member 40 now moves clockwise in the direction of arrow "C" under the influence of the second portion or opposite end 44*b* of the torsion coil spring, the opposite end being secured to rotary member 40. When the rotary member is moved clockwise by the torsion coil spring, card push-out portion 40*a* of the rotary member engages the front or lead edge C1 of memory card C to eject the memory card in the direction of arrow "D".

Figure 6:
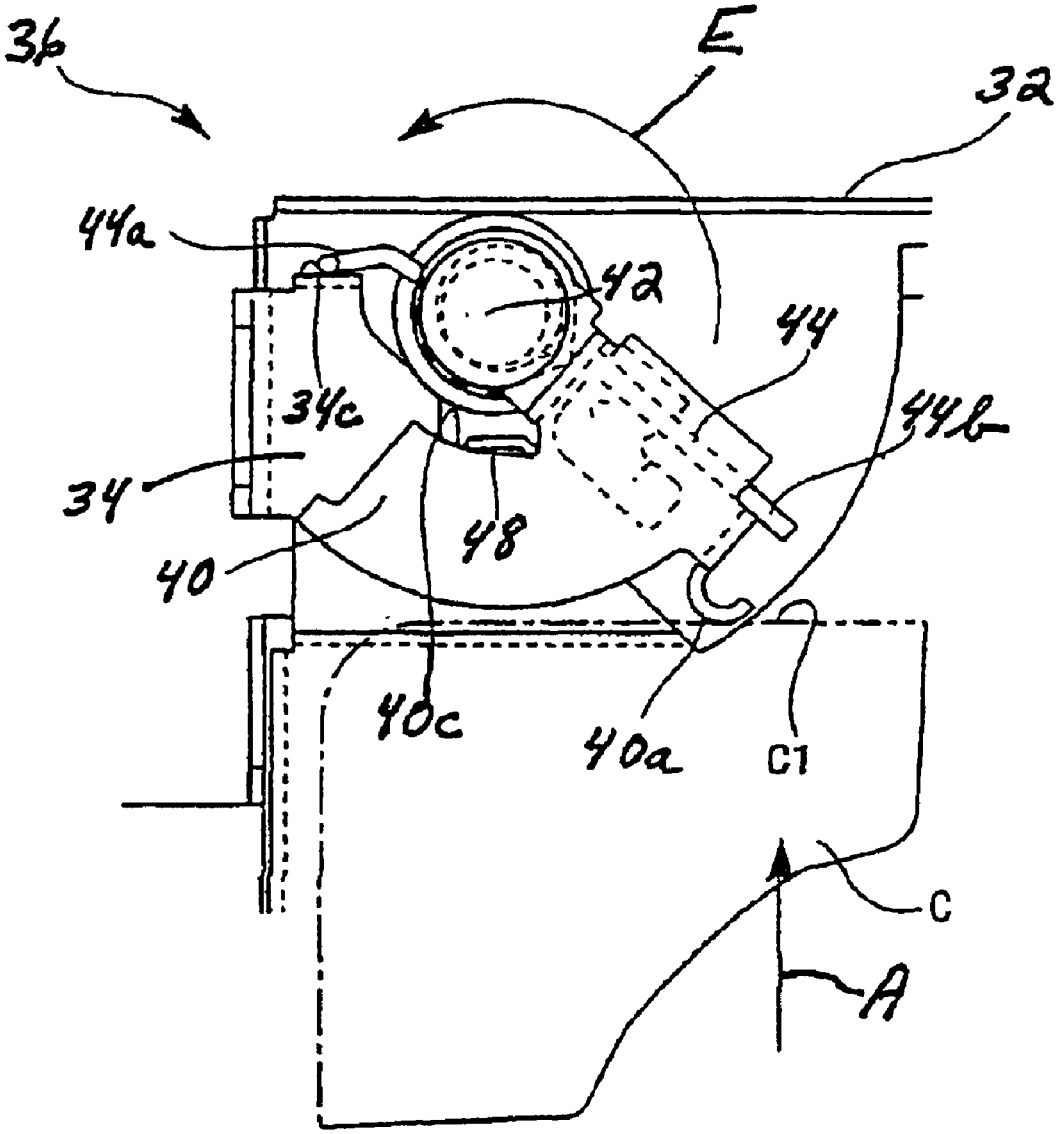
Figure 7:
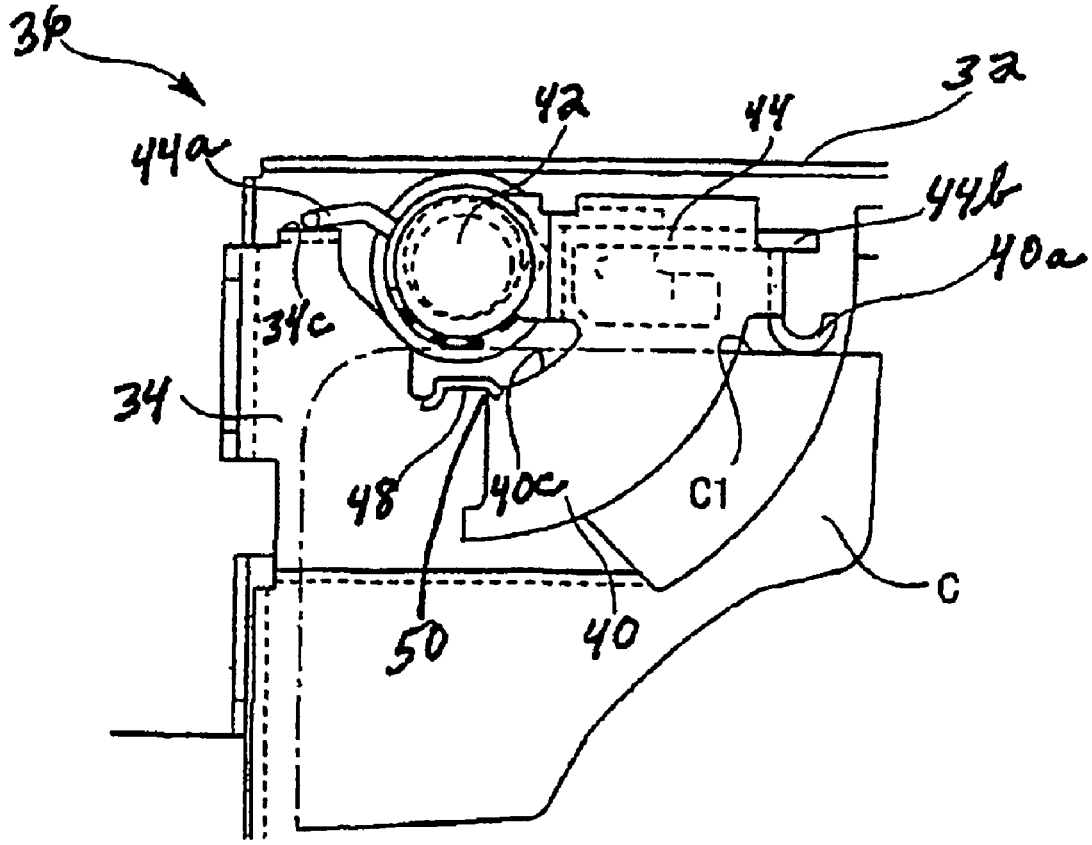
Figure 8:
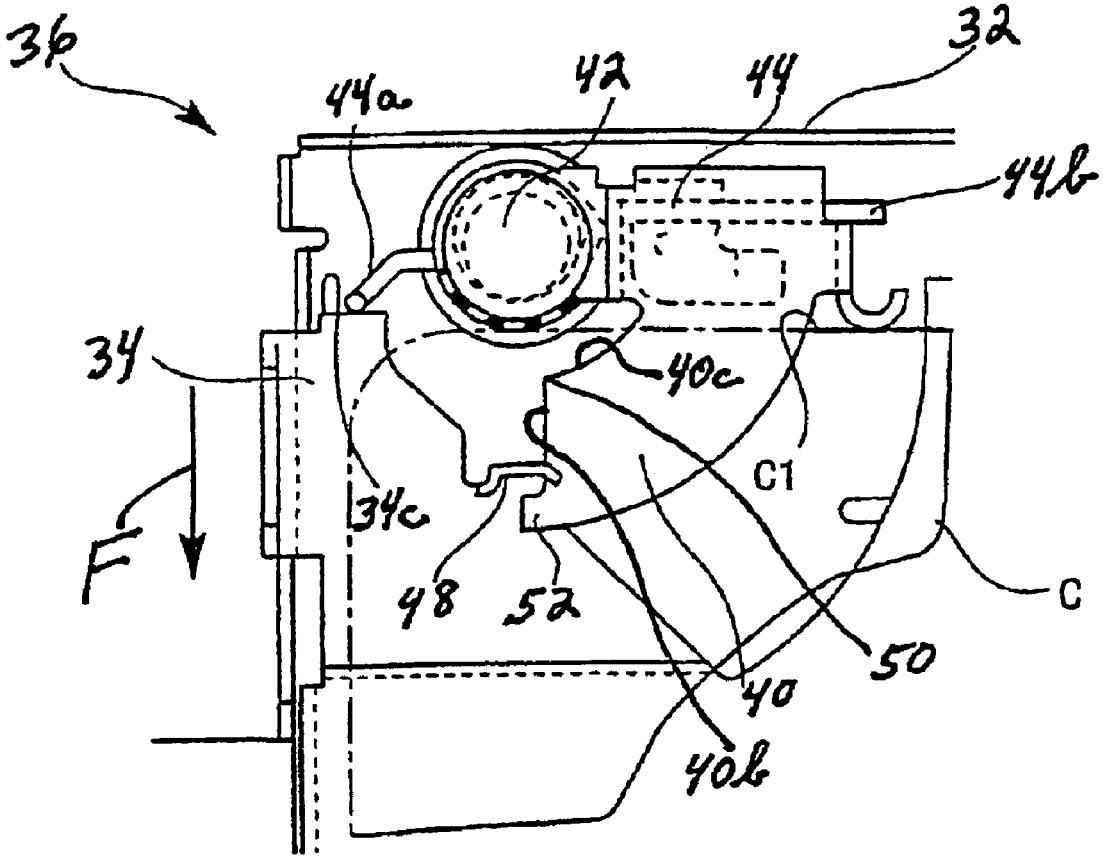
Figure 9:
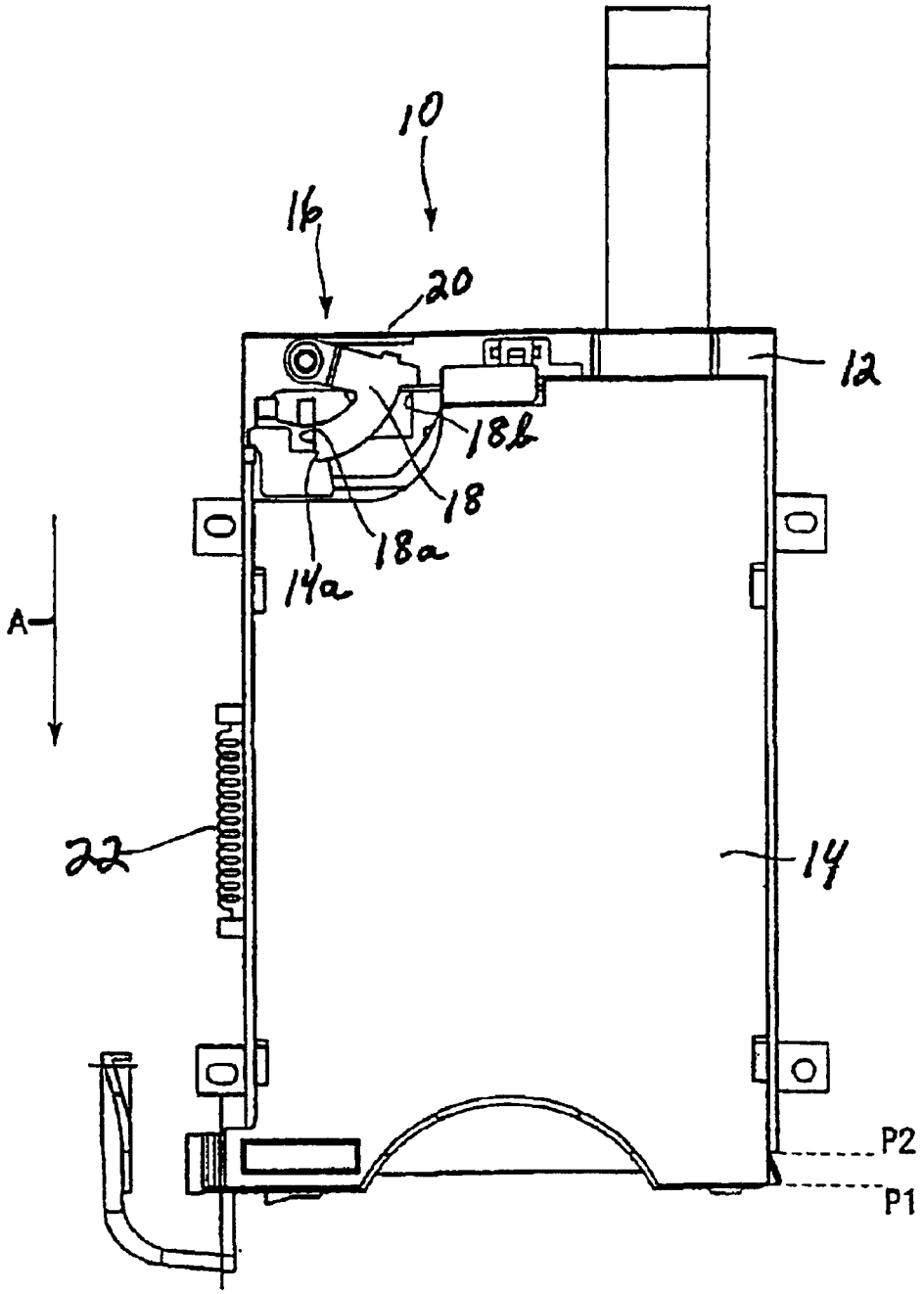
FIG. 9 is a plan view of a prior art card connector, as described in the "Background", above.

FIGS. 6, 7 and 8 basically are duplications of FIGS. 5, 4 and 3, respectively, to show the reverse action of eject device 36 when memory card C is inserted into the connector in the direction of arrow "A" (FIG. 6). Specifically, lead edge C1 of memory card C engages card push-out portion 40*a* on rotary member 40 to move the rotary member counterclockwise in the direction of arrow "E" while, at the same time, biasing or cocking the second portion or opposite end 44*b* of torsion coil spring 44 also in the counterclockwise direction.

Further movement of memory card C toward its fully inserted or mated position is shown in FIG. 7. However, cover 34 has yet to move back from its eject position P2 to its inoperative position P1, because latch arm 48 has yet to reach end-point 50 of latch surface 40*b*.

FIG. 8 shows that latch arm 48 on cover 34 has passed end-point 50 and has moved along latch surface 40*b*, as the first portion or end 44*a* of the torsion coil spring has moved cover 34 back to its inoperative position in the direction of arrow "F" FIG. 8 shows that rotary member 40 has a protruding engagement portion 52 which defines a stop for engaging latch arm 48 when the cover returns to its inoperative position. In other words, the stop defined by protruding portion 52 defines the outer or inoperative position of the cover, while inner circumferential surface 40*c* of the rotary member defines the inner or eject position of the cover.

It will be understood that the invention may be embodied in other specific forms without departing from the spirit or central characteristics thereof the present examples and embodiments, therefore, are to be considered in all respects as illustrative and not restrictive, and the invention is not to be limited to the details given herein.

What is claimed is:

1. A memory card connector, comprising:

a main body, a cover mounted on the body for receiving a memory card therebetween, the card being insertable to a fully mated position, and the cover being mounted for movement on the body from an inoperative position to an eject position;

an eject device including a single spring mounted on the body and having a first portion operatively associated with the cover to bias the cover toward its inoperative position, and a second portion operatively associated with the memory card for biasing the card in an eject direction away from its mated position; and inhibiting means operatively associated between the cover and said second portion of the single spring to prevent the second portion from ejecting the card until the cover substantially reaches its eject position.

2. The memory card connector of claim 1 wherein said single spring comprises a torsion coil spring.

3. The memory card connector of claim 2 wherein said torsion coil spring has one end thereof engageable with the cover.

4. The memory card connector of claim 3 wherein said torsion coil spring has an opposite end thereof operatively associated with the memory card.

5. The memory card connector of claim 4 wherein said opposite end of the torsion coil spring is attached to a rotary member of the eject device.

6. The memory card connector of claim 5 wherein said rotary member has a portion operatively associated with the cover to define the eject position of the cover.

7. The memory card connector of claim 6 wherein said rotary member has a second portion operatively associated with the cover to define the inoperative position of the cover.

8. The memory card connector of claim 5 wherein said rotary member is mounted for rotation about an axis coincident with an axis of the torsion coil spring.

9. The memory card connector of claim 8 wherein said inhibiting means are operatively associated between the cover and said rotary member.

10. The memory card connector of claim 9 wherein said inhibiting means include a latch arm on the cover engageable with a latch surface on the rotary member.

11. The memory card connector of claim 10 wherein said latch arm is positioned for moving off the latch surface when the cover substantially reaches its eject position.

12. A memory card connector, comprising:

a main body, a cover mounted on the body for receiving a memory card therebetween, the card being insertable to a fully mated position, and the cover being mounted for movement on the body from an inoperative position to an eject position; and an eject device including a single spring mounted on the body and having a first portion operatively associated with the cover to bias the cover toward its inoperative position, and a second portion operatively associated with the memory card for biasing the card in an eject direction away from its mated position.

13. The memory card connector of claim 12 wherein said single spring comprises a torsion coil spring.

14. The memory card connector of claim 13 wherein said torsion coil spring has one end thereof engageable with the cover.

15. The memory card connector of claim 14 wherein said torsion coil spring has an opposite end thereof operatively associated with the memory card.

16. The memory card connector of claim 15 wherein said opposite end of the torsion coil spring is attached to a rotary member of the eject device.

17. The memory card connector of claim 16 wherein said rotary member is mounted for rotation about an axis coincident with an axis of the torsion coil spring.

18. The memory card connector of claim 15 wherein said rotary member has a portion operatively associated with the cover to define the eject position of the cover.

19. The memory card connector of claim 18 wherein said rotary member has a second portion operatively associated with the cover to define the inoperative position of the cover.

* * * * *